US008398273B2

(12) United States Patent
Eberhardt

(10) Patent No.: US 8,398,273 B2
(45) Date of Patent: Mar. 19, 2013

(54) SURFACE-MOUNTED OR WALL-MOUNTED LUMINAIRE

(75) Inventor: Marcus Eberhardt, Aixheim (DE)

(73) Assignee: Waldmann GmbH & Co. KG, Villingen-Schwenningen (DE)

( * ) Notice: Subject to any disclaimer, the term of this patent is extended or adjusted under 35 U.S.C. 154(b) by 0 days.

(21) Appl. No.: 13/145,376

(22) PCT Filed: Oct. 29, 2009

(86) PCT No.: PCT/EP2009/007770

§ 371 (c)(1),
(2), (4) Date: Sep. 12, 2011

(87) PCT Pub. No.: WO2010/088936

PCT Pub. Date: Aug. 12, 2010

(65) Prior Publication Data

US 2011/0310599 A1 Dec. 22, 2011

(30) Foreign Application Priority Data

Feb. 3, 2009 (DE) ..... 10 2009 007 308

(51) Int. Cl.
*F21V 7/04* (2006.01)
*F21S 8/00* (2006.01)

(52) U.S. Cl. ..... 362/300; 362/301; 362/307; 362/346; 362/147

(58) Field of Classification Search ..... 362/297, 362/298, 300, 301, 307, 346, 404, 147, 145, 362/217.01, 223, 224, 217.05, 217.1, 217.11
See application file for complete search history.

(56) References Cited

U.S. PATENT DOCUMENTS 2,327,230 A 8/1943 Weber
3,077,536 A 2/1963 Garnett
4,054,793 A 10/1977 Shemitz (Continued)

FOREIGN PATENT DOCUMENTS

CN 2 615 491 Y 5/2004
CN 2010/78668 Y 6/2008

(Continued)

OTHER PUBLICATIONS

International Search Report for PCT/EP2009/007770 mailed Jun. 15, 2010, 5 pages—German, 5 pages—English translation.

(Continued)

*Primary Examiner* — Thomas Sember
(74) *Attorney, Agent, or Firm* — Andrew F. Young, Esq.; Lackenbach Siegel, LLP

(57) ABSTRACT

The invention relates to an elongate light fixture having a substantially triangular cross-section. The light fixture is screwed to a supply duct with the rear wall thereof. A front rail runs parallel to the rear wall. Transparent panels and are inserted detachably between the rear wall and rail. In the interior of the light fixture, a fluorescent lamp is provided as the luminous element. The light emitted by said fluorescent lamp is reflected upward by way of reflector surfaces that open in the shape of a funnel and is scattered diffusely in the direction A by means of the frosted panel. The panel surfaces, which likewise open in the shape of a funnel, reflect the light exiting downward from the lamp in the direction toward the panel, the grooved structure of which ensures that the light is deflected substantially in the direction B, while the portion of the side light exiting in the direction C is reduced. With this reflector and panel configuration, firstly good illumination of the space and secondly specific and glare-free workplace lighting is made possible.

17 Claims, 7 Drawing Sheets

U.S. PATENT DOCUMENTS

| | | | | |
|---|---|---|---|---|
| 6,729,741 | B1 * | 5/2004 | Murray | 362/147 |
| 6,733,154 | B1 * | 5/2004 | Dahlen | 362/224 |
| 6,789,914 | B1 * | 9/2004 | Brown et al. | 362/147 |
| 7,249,870 | B1 | 7/2007 | Shwisha | |
| 7,585,088 | B2 * | 9/2009 | Tyson | 362/225 |
| 2002/0118537 | A1 | 8/2002 | Segretto | |
| 2004/0037068 | A1 | 2/2004 | Patterson | |
| 2006/0232961 | A1 | 10/2006 | Pfund | |

FOREIGN PATENT DOCUMENTS

| | | | |
|---|---|---|---|
| DE | 20 2007 004239 | U1 | 8/2007 |
| EP | 0 739 618 | A1 | 10/1996 |
| EP | 0 806 605 | A2 | 11/1997 |
| EP | 0 952 390 | A2 | 10/1999 |
| EP | 1 365 189 | A2 | 11/2003 |
| GB | 2 365 111 | A | 2/2002 |

OTHER PUBLICATIONS

Chinese Office Action for Chinese Pat. Appln. No. 2009 8015 5907 mailed on Sep. 27, 2012, 11 pages—English.

* cited by examiner

SURFACE-MOUNTED OR WALL-MOUNTED LUMINAIRE

CROSS REFERENCE TO RELATED APPLICATIONS

This application claims priority from PCT Patent Application Ser. No. PCT/EP2009/007770, filed Oct. 29, 2009, the entire contents of which is herein incorporated fully by reference, which in turn claims priority form German Patent Application Serial No. 10 2009 007 308.6 filed Aug. 3, 2009.

FIGURE FOR PUBLICATION

FIG. 2

BACKGROUND OF THE INVENTION

1. Field of the Invention

The present invention relates to a surface-mounted or wall-mounted luminaire with improved reflection. More particularly, the present invention relates to an elongate light fixture having a substantially triangular cross-section with a particular construction substantially enhancing direct and reflected light and which is operably useful in installation.

2. Description of the Related Art

The related art involves surface-mounted luminaries substantially composed of an elongated housing having an approximately triangular cross-section, the back wall of the housing being fastened to the media distributor. Inside the housing, a fluorescent lamp is disposed, the light of which is emitted directly to the workplace or indirectly in the direction of the room ceiling by way of reflectors that extend parallel to the lamp and screens disposed at an angle relative to each other.

A surface-mounted luminaire for media supply is known from DE 20 2007 004 239 U1, which is incorporated by reference. Based upon this reference it is difficult to achieve an optimal workplace and space illumination while also being both easy to install and highly service-friendly.

To solve the lighting problem, the surface-mounted luminaire provided is suitable for attachment to both the aforementioned media distributor or to a vertical wall.

Accordingly, there is a need for an improved device enabling surface-mounting or wall-mounting luminaires, especially that is both easy to install and highly service-friendly.

ASPECTS AND SUMMARY OF THE INVENTION

The proposed invention provides an elongate light fixture having a substantially triangular cross-section. The light fixture is screwed to a supply duct with the rear wall thereof A front rail runs parallel to the rear wall. Transparent panels and are inserted detachably between the rear wall and rail. In the interior of the light fixture, a fluorescent lamp is provided as the luminous element. The light emitted by said fluorescent lamp is reflected upward by way of reflector surfaces that open in the shape of a funnel and is scattered diffusely in the direction A by means of the frosted panel. The panel surfaces, which likewise open in the shape of a funnel, reflect the light exiting downward from the lamp in the direction toward the panel, the grooved structure of which ensures that the light is deflected substantially in the direction B, while the portion of the side light exiting in the direction C is reduced. With this reflector and panel configuration, firstly good illumination of the space and secondly specific and glare-free workplace lighting is made possible.

An aspect of the present invention is to provide a luminaire that significantly improves the quality of the directly and indirectly emitted light. This is achieved, for one, by a particular reflector geometry, which ensures the emission of extremely homogeneous light both upward and downward relative to a fixed position, and secondly by the configuration of the screens which cover the luminaire toward the top and the bottom and by which the light is scattered diffusely upward and the light is oriented downward such that the portion of horizontally exiting light is as low as possible.

It is another aspect of the proposed invention that reflector configurations are provided which both favor the light direction described and are economical to produce and install.

It is also an aspect of the proposed invention that the screens used for light direction are removably insertedable.

It is another aspect of the proposed invention that the resultant unit is easy production and improves the service friendliness, while offering safe handling for installers.

It is another aspect of the proposed invention that at least one screen, located at the top, can be pivoted away for service purposes and that optionally a bottom screen can be securely fastened.

It is another aspect of the proposed invention that solutions are proposed for fastening the lateral parts to the luminaire housing and for fastening the luminaire to a supply duct or a wall.

Another aspect of the present invention provides a luminaire that is configured so that a plurality of luminaires of this type can be disposed in series next to one another, as is desirable for the aforementioned media distributor.

Another aspect of the present invention provides a luminaire element that is not only easy to orient in series, but also is easy to install and remove.

The above, and other aspects, features and advantages of the present invention will become apparent from the following description read in conduction with the accompanying drawings, in which like reference numerals designate the same elements.

DETAILED DESCRIPTION OF THE PREFERRED EMBODIMENTS

Figure 1:
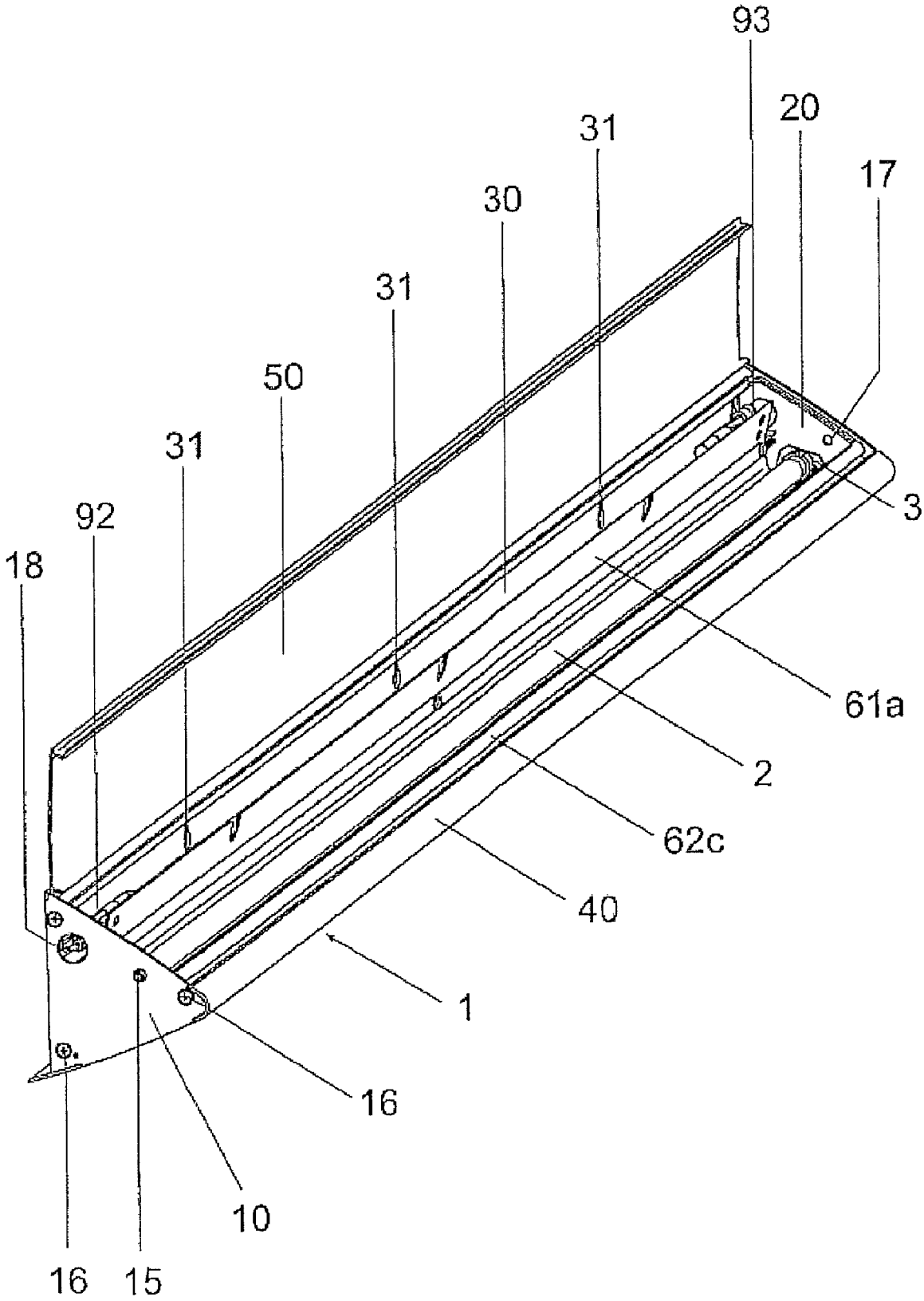
FIG. 1 is a perspective illustration of a luminaire according to the invention, in which the top screen is open.

Reference will now be made in detail to several embodiments of the invention that are illustrated in the accompanying drawings. Wherever possible, same or similar reference numerals are used in the drawings and the description to refer to the same or like parts or steps. The drawings are in simplified form and are not to precise scale. For purposes of convenience and clarity only, directional terms, such as top, bottom, up, down, over, above, and below may be used with respect to the drawings. These and similar directional terms should not be construed to limit the scope of the invention in any manner. The words "connect," "couple," and similar terms with their inflectional morphemes do not necessarily denote direct and immediate connections, but also include connections through mediate elements or devices.

The luminaire housing is substantially composed of a rear wall 30, to which lateral parts 10 and 20 are screwed perpendicularly by countersunk head screws 16, the lateral parts being connected to one another at the front by means of a profiled rail 40. This rail is also connected to the lateral parts 10 and 20 by means of countersunk head screws 16.

Figure 3A:
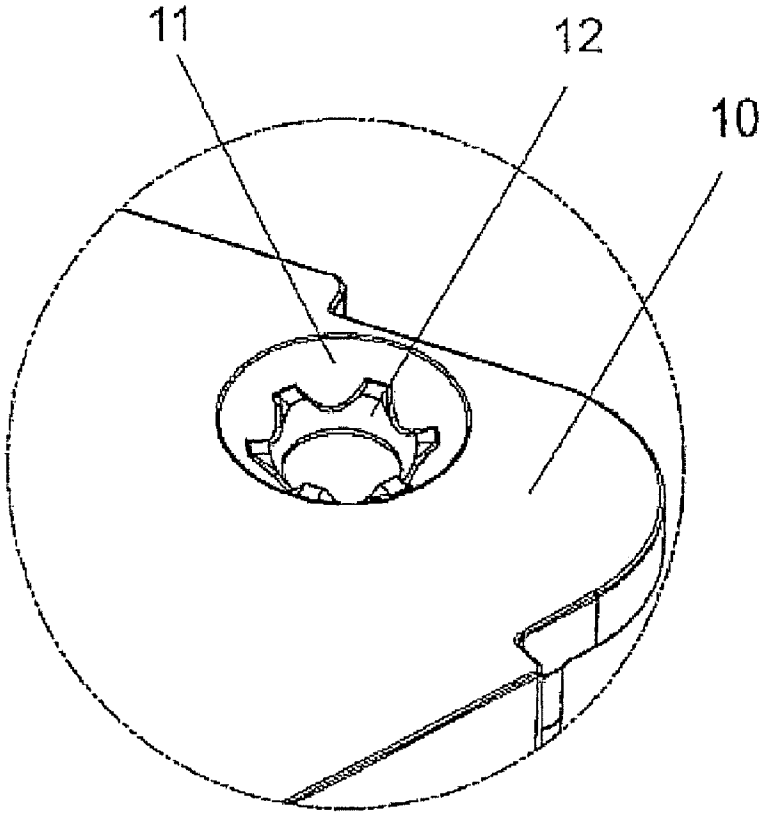
FIG. 3A is an enlarged detail III of the lateral part shown in FIG. 3.

As is apparent in particular from FIG. 3A, the countersunk holes 11 for receiving the countersunk head screws 16 are provided with lobular recesses 12, which remove the paint adhering to the countersunk head screw when the same is screwed in and thereby ensure good electrical connection between the lateral parts 10, the countersunk head screws 16 and the rear wall 30 connected thereto or the front profiled rail 40.

Inside the housing, a fluorescent lamp 2 is provided as the luminous element 2, which is inserted in bases 3 attached to the lateral parts 10 and 20.

Reflectors are disposed between the rear wall 30 and fluorescent lamp 2, with the drawing showing the reflector surfaces 61*a* and 62*c*.

The luminaire is covered toward the top and the bottom by transparent screens, of which only the upwardly folded-open screen 50 is shown in FIG. 1.

For the electrical connection of the luminaire, connecting cables 91 are provided inside the luminaire housing between the rear wall 30 and the reflector 61*a*, wherein the plugs 92 and sockets 93 located at the ends of the cables are shown, which can be guided through feedthrough openings 18 or 18' provided in the lateral walls 10 or 20. Moreover, locking pins 15 and detent openings 17 associated with one another are provided in the lateral parts 10 and 20 and are used to orient and lock the luminaire elements disposed in series, as will be explained in more detail hereinafter.

Keyhole-shaped openings 31 are provided in series next to one another for fastening the luminaire 1 to a rear wall, which is not shown in FIG. 1.

Figure 2:
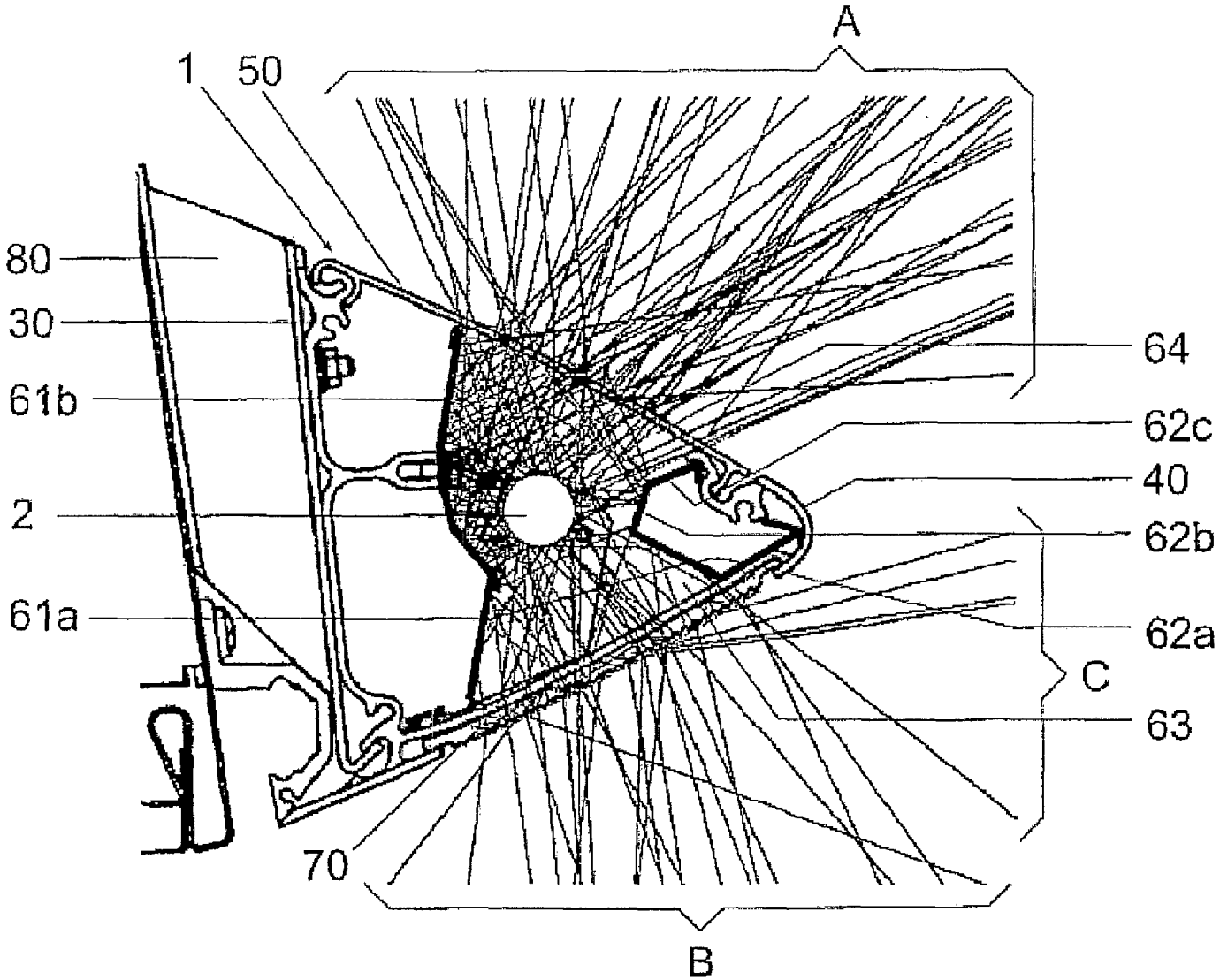
FIG. 2 is a cross-section of the luminaire installed on a supply duct, having a schematically indicated beam path.

The most important measures for the configuration of the luminaire according to the invention relate to the light distribution and light direction, the latter being illustrated by the cross-section according to FIG. 2, which schematically indicates the light beams generated by the lamp 2 for generating the indirect light A, for generating the direct light B and the lateral light C.

The light direction symbolized here is made possible by the special configuration of the rear reflector comprising the reflector surfaces 61*a* and 61*b* and the front reflector comprising the reflector surfaces 62*a*, 62*b* and the screens 50 and 70.

The reflector surfaces 61*a* and 62*a* delimit a bottom chamber 63 opening downward in a funnel shape, and the reflector surfaces 61*b*, 62*b*, and 62*c* delimit a top chamber 64 opening upward in a funnel shape.

The bottom chamber 63 is covered by a bottom screen 70 having a flute-shaped structure. The reflector surfaces 61*a* and 62*a*, together with the fluted bottom screen 70, cause the light generated by the lamp 2 for illuminating the workplace to be deflected notably perpendicularly downward in the direction B, while laterally emitted light in direction C is substantially suppressed, which results in extraordinarily good freedom of glare.

The top chamber 64 is covered by a frosted screen 50. The light emitted upward by the lamp 20 is reflected by means of the reflector surfaces 61*b*, 62*b* and 62*c* and diffusely scattered more strongly by means of the frosted screen 50 than by the bottom screen 70, whereby indirect light that is emitted in direction A and reflected by the room ceiling is generated.

For design reasons, the reflector surfaces 61*a* and 61*b* and the reflector surfaces 62*a*, 62*b* and 62*c* are integrally produced, respectively.

The design measures also proposed by the invention and described in more detail based on the remaining figures are no less important for production, installation and maintenance.

The configurations and arrangements of the top screen 50 and bottom screen 70 are important for installation and maintenance; they are disposed between the rear wall 30 and the forward rail 40, which are advantageously produced as extruded sections.

Figure 4A:
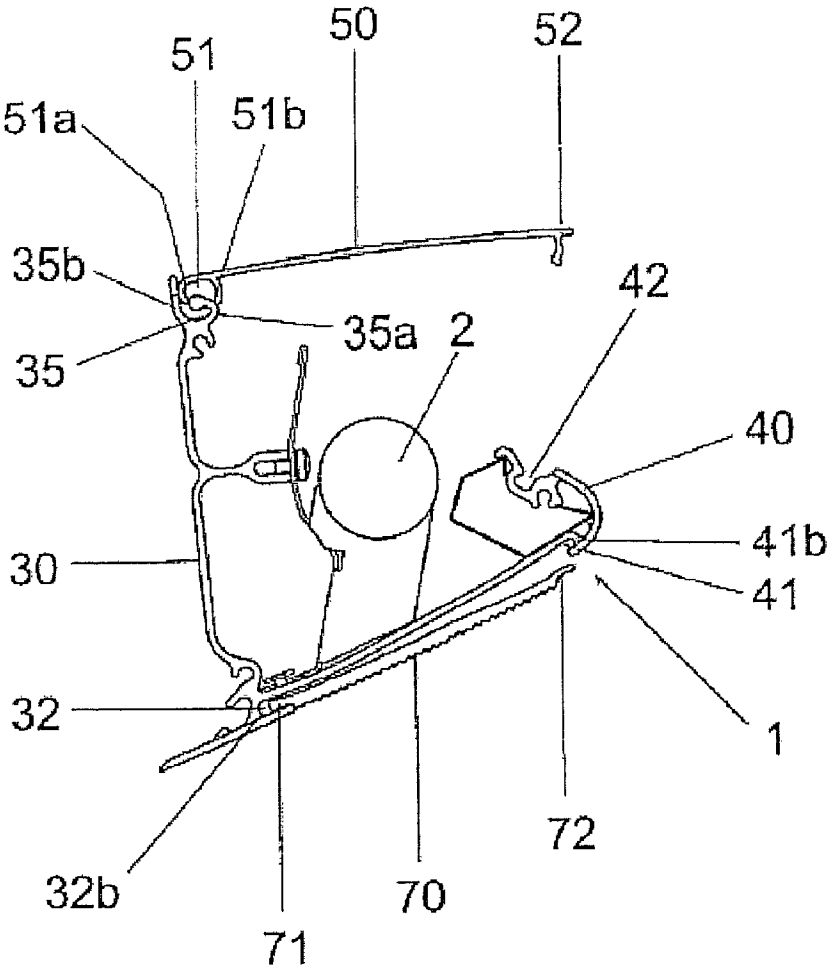
FIG. 4A is a cross-section according to FIG. 4 with partially open screens.
Figure 4:
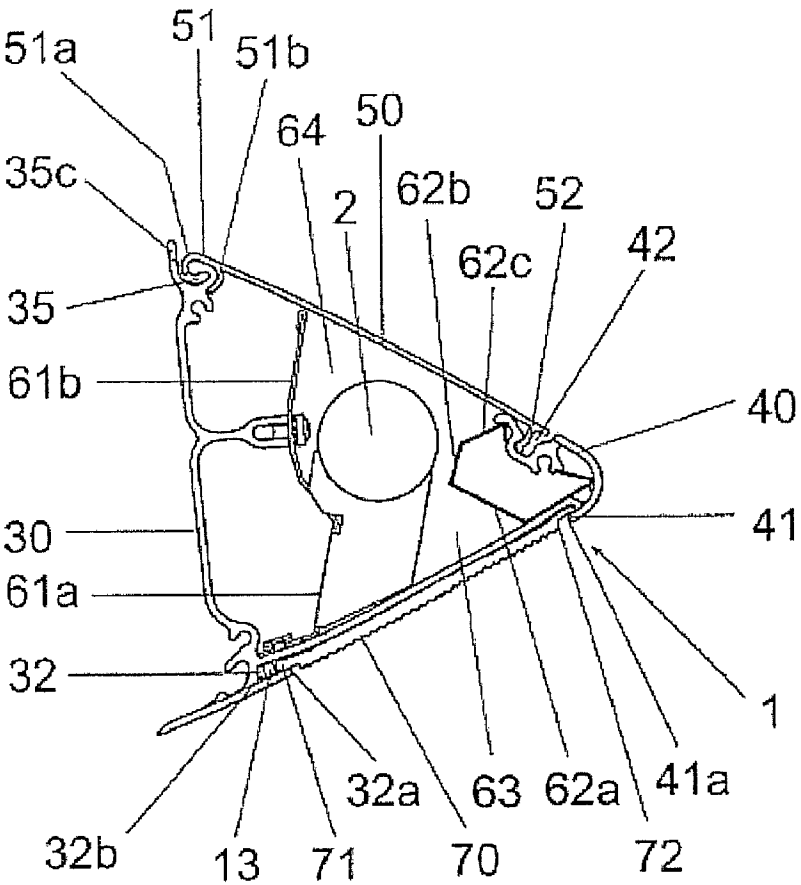
FIG. 4 is a cross-section of the luminaire according to FIG. 1 close to the lateral part 10 with closed screens.

With a lip 51*a* which is located at the rear edge 51 and bent downwardly, the top screen 50 is pivotably suspended in a flute 35 provided at the upper edge of the rear wall. The top screen 50 can thus be pivoted away toward the top, as is shown in FIG. 4*a*. A front lip 51*b*, which likewise runs at the rear edge of the top screen 50 parallel to the lip 51*a* and is seated against the front wall part 35*a* of the rear wall 30 that delimits the flute 35, prevents the top screen 50 from being detached when it is folded up. Given this special shape, the top screen 50 can also be easily installed and removed without tools.

Figure 7:
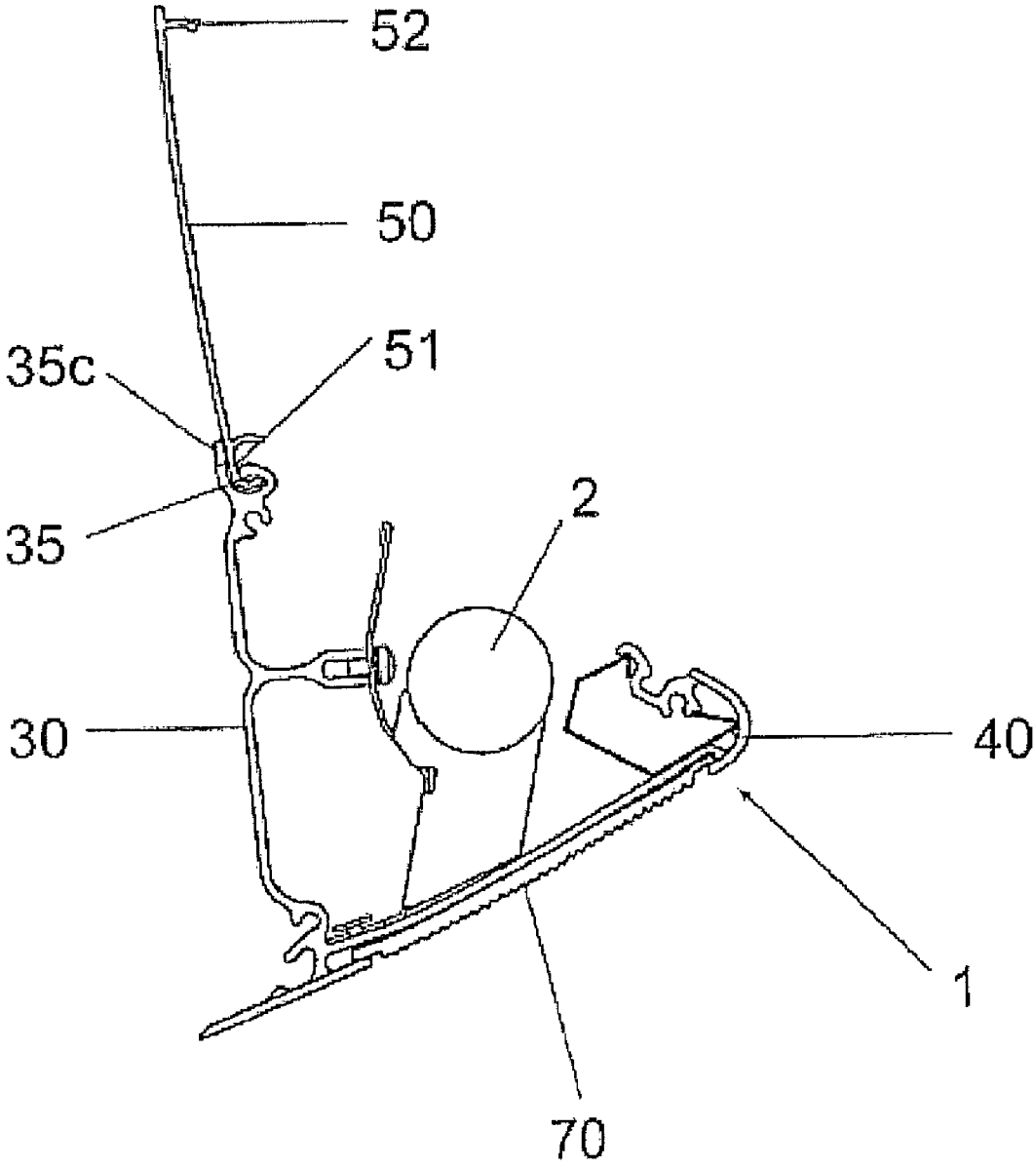
FIG. 7 is a cross-section of the luminaire according to FIG. 4 with the top screen being entirely folded open.

The rear wall 30 advantageously transitions upward into an extension 35*c* forming a stop for the screen 50, the operating principle of the extension being apparent in particular from FIG. 7.

This configuration makes it possible for the screen 50 to be locked in the folded-up state, so that the service technician has both hands free when replacing the lamp, performing the repair work or cleaning.

At the front end, the closed top screen 50 engages with a groove 42 of the profiled rail 40 via a downwardly directed, elastically spring-loaded lip 52 for locking purposes. The top screen 50 and the profiled rail 40 are dimensioned such that, when the screen 50 is closed, the surface thereof is flush with the surface of the rail 40, so that only a narrow gap is formed between the mutually adjoining edges of the screen 50 and rail 40. This substantially prevents accidental opening of the screen, because a tool, for example a screwdriver to be introduced in the gap, is required for opening.

For service purposes, for example to replace a lamp 2, it suffices to open the top screen 50, and the bottom screen 70 can remain fixedly installed. However, so as to enable economical production, the rear wall 30, rail 40 and the lateral parts 10 and 20 are configured so that easy installation and removal are possible. The screen 70, for example, comprises edges 71 that are tapered on both sides relative to the screen thickness, which are removably inserted on one side in a groove 32 of the profiled rear wall 30 and on the other side in a groove 41 of the profiled rail 40. The distance between the mutually facing edges 32*a* of the rear wall 30, and 41*a* of the rail 40, is smaller than the width of the inserted screen 70, while the distance of the bases 41*b* of the groove 41, and 32*b* of the groove 32, is larger than the width of the bottom screen 70, whereby easy insertion and retention of the screen 70 are assured. So as to fix the screen 70 in the position thereof, a fixing pin 13 engages in the intermediate space between the groove base 32*b* and the edge 71 of the screen 70, the pin being provided on the lateral part 10, as is shown in particular in FIG. 3. The edges 71 and 72 of the bottom screen 70 and the screen are dimensioned such that a smooth transition is obtained when the screen 70 is inserted.

In particular when using the luminaire as a luminaire element in a lighting strip, the easy and flush installation thereof is required. For this purpose, a series of keyhole-shaped openings 31 are provided in the rear wall 30 of the luminaire 1, which have already been mentioned in connection with FIG. 1.

Figure 5:
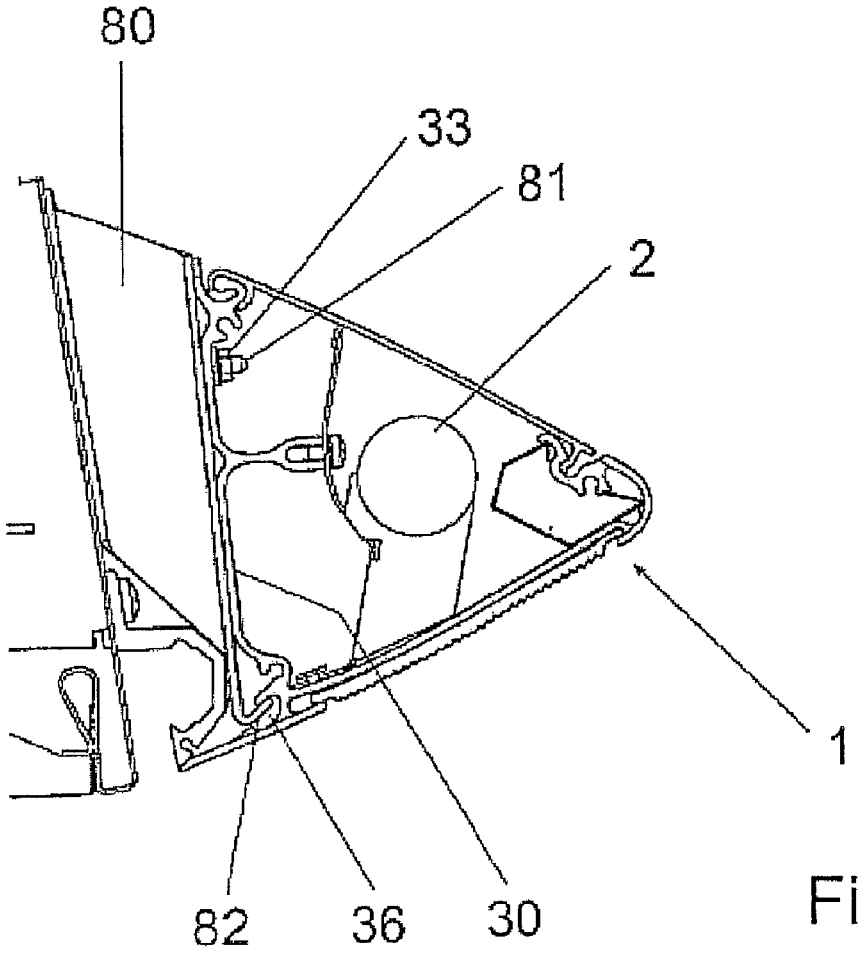
FIG. 5 is a cross-section of the luminaire screwed onto a supply duct.
Figure 5A:
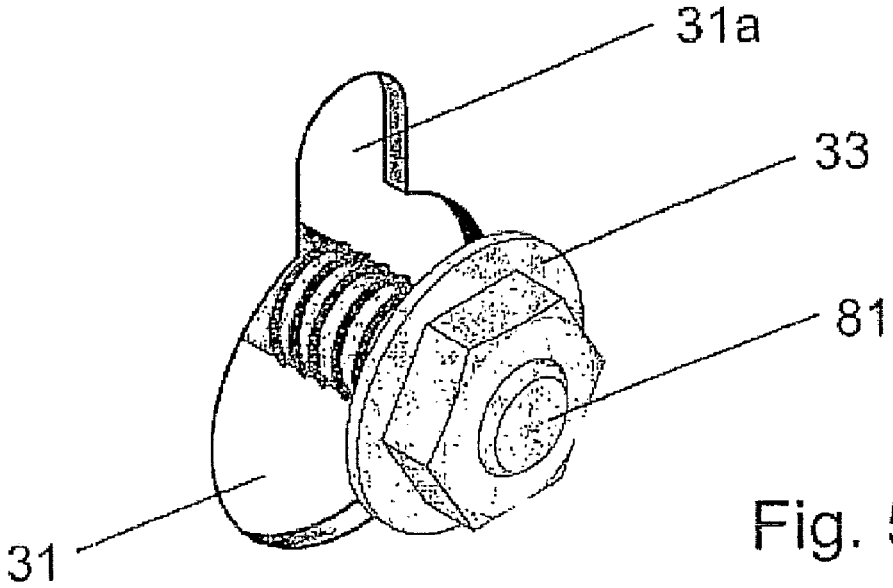
FIG. 5A is an enlarged perspective detailed illustration of a keyhole-shaped opening provided in the rear wall, comprising a threaded pin used for fastening and a nut.

The special configuration of the openings is shown in the perspective illustration according to FIG. 5A. During installation, the luminaire 1 is placed on threaded pins 81 located on the supply duct 80, which penetrate the keyhole-shaped openings 31. The nuts, preferably self-locking nuts 33 with serrated bearing surfaces, screwed onto the threaded pins 81 must be tightened to fix the luminaire 1. The elongated hole 31 a provided on the opening 31 makes it possible to orient the luminaire 1 vertically.

To further fix the position of and mount the luminaire, an upwardly bent lug 82 which engages in a receiving flute 36 of the rear wall 30 is provided at the lower end of the supply duct 80. This ensures secure fastening of the luminaire. As soon as the luminaire 1 is suspended on the threaded pins 81 and the self-locking nuts 33 with serrated bearing surfaces are screwed on, the luminaire is fixed in place. The lug 82 prevents the luminaire from being pushed upward. Even if the self-locking nut 33 with serrated bearing surfaces is not tightened, secure fastening is assured.

Figure 6A:
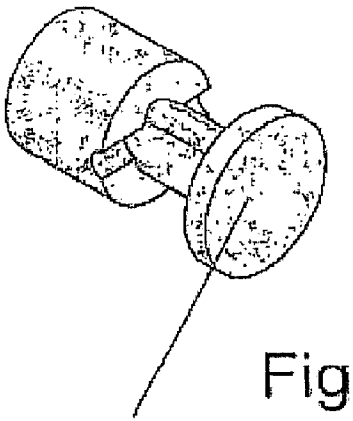
FIG. 6A is a perspective larger illustration of a locking pin used to mechanically connect the luminaire elements.
Figure 6:
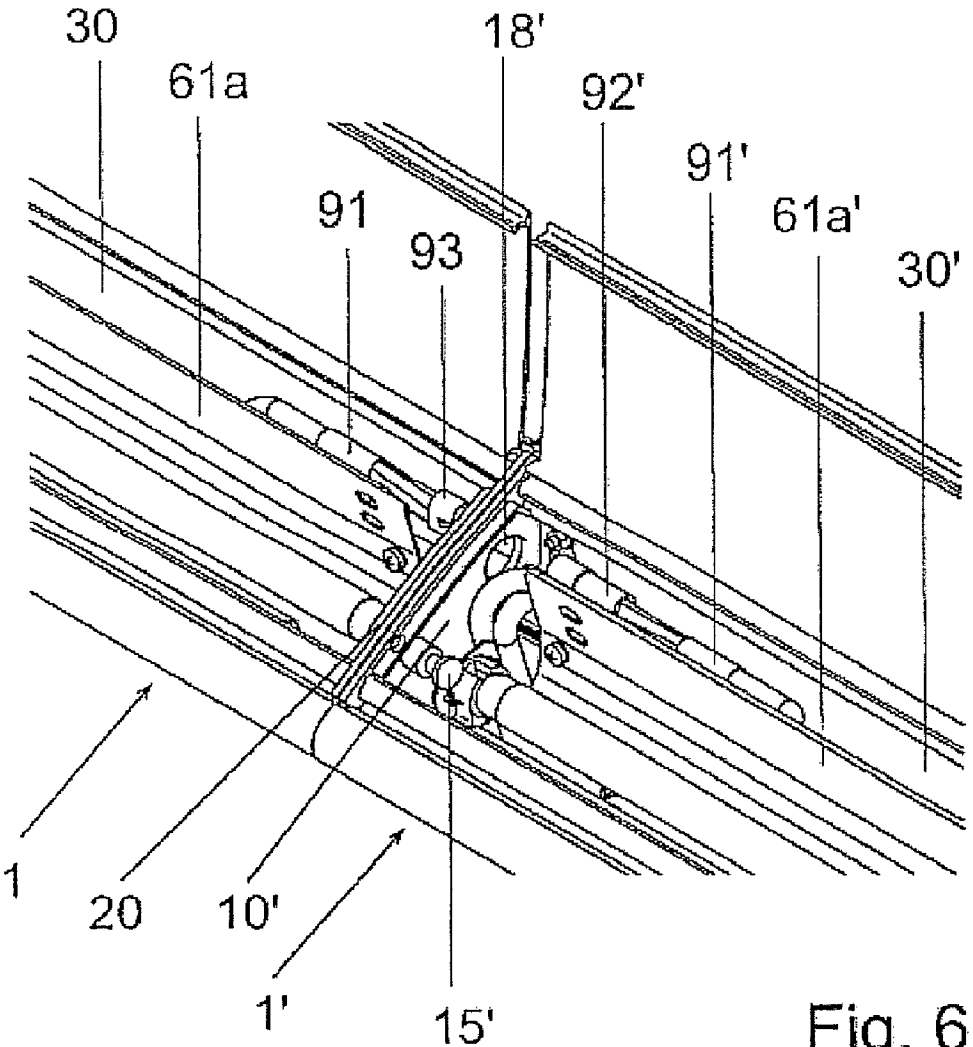
FIG. 6 is a perspective partial views of two luminaire elements having top screens that are folded open, the elements being disposed in series and connected to one another.

When the luminaire elements 1, 1' are used in a strip lighting fixture, as is shown in FIG. 6, it is important that they are oriented such that they are aligned with one another.

Figure 3:
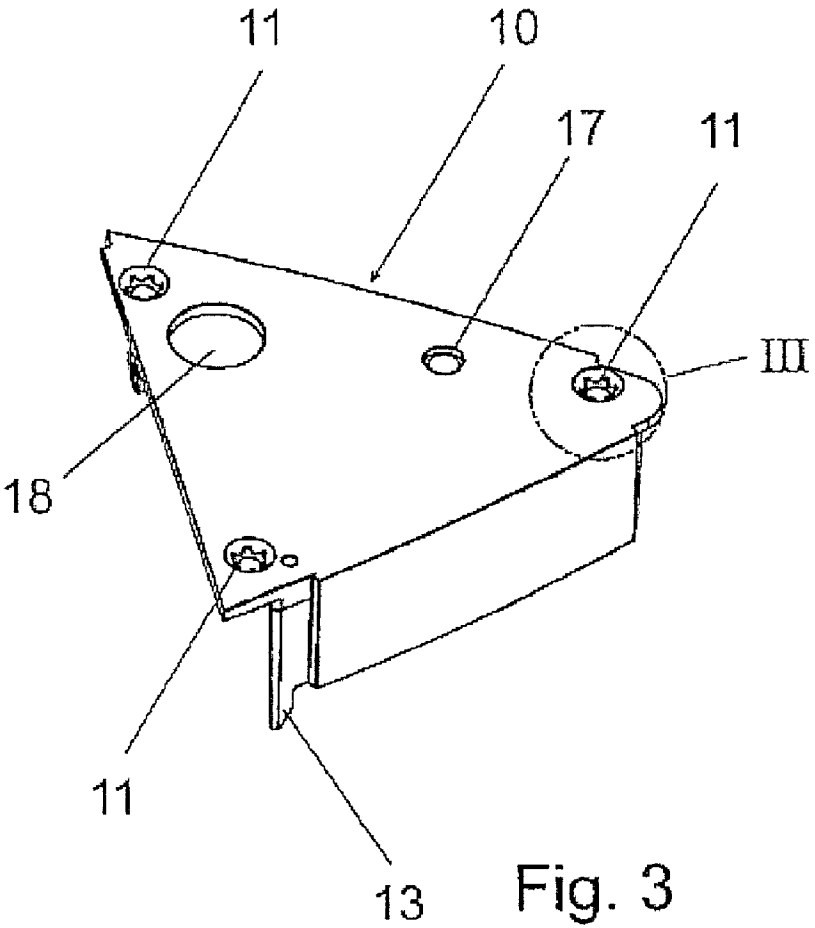
FIG. 3 is a perspective and enlarged illustration of one of the two lateral parts of the luminaire shown in FIG. 1.

So as to ensure or facilitate this, a spring-loaded locking pin 15' is provided in each lateral wall 10', the pin engaging in a detent opening 17 associated therewith, which is apparent, for example, from FIGS. 1 and 3. During removal, this locking pin 15' must be loosened.

To remove a luminaire element 1 or 1' from the lighting strip, not only the fastening and locking elements 81 and 15 must be loosened, but the electrical connections of the cables 91, 91' must also be disconnected. For this reason, the cables 91, 91' are equipped at the mutually associated ends with plugs 92' or sockets 93, which can easily be connected to one another and disconnected from one another.

The spaces between the rear walls 30, 30' and the reflector surfaces 61*a* and 61*a'* are dimensioned such that, after the connecting cables 91 and 91' are disconnected, they can be stored together with the sockets 93 and plugs 91' without difficulty behind the reflectors 61*a* and 61*a'*.

In the claims, means or step-plus-function clauses are intended to cover the structures described or suggested herein as performing the recited function and not only structural equivalents but also equivalent structures. Thus, for example, although a nail, a screw, and a bolt may not be structural equivalents in that a nail relies on friction between a wooden part and a cylindrical surface, a screw's helical surface positively engages the wooden part, and a bolt's head and nut compress opposite sides of a wooden part, in the environment of fastening wooden parts, a nail, a screw, and a bolt may be readily understood by those skilled in the art as equivalent structures.

Having described at least one of the preferred embodiments of the present invention with reference to the accompanying drawings, it is to be understood that the invention is not limited to those precise embodiments, and that various changes, modifications, and adaptations may be effected therein by one skilled in the art without departing from the scope or spirit of the invention as defined in the appended claims.

The invention claimed is:

1. A luminaire, comprising:

an elongated housing having a rear wall positionable proximate a support surface;

the housing having an approximately triangular cross-section, and further comprising:

a luminous element disposed inside the housing;

a plurality of screens generally bounding portions of the luminous element and designating a respective top chamber having a top screen and a bottom chamber having a bottom screen;

the screens extending generally parallel to said luminous element and being operably located at angles relative to one another for emitting direct and indirect light and closing respective top and bottom chambers, a downwardly oriented reflector for generating downwardly oriented direct light;

an upwardly oriented reflector for generating upwardly oriented direct light;

the reflector for generating downwardly oriented direct light, further comprising:

two flat reflector surfaces disposed at angles relative to one another;

the reflector for generating upwardly oriented direct light, further comprising:

a reflector surface that is generally parabolically curved in a direction of the luminous element, and located oppositely said reflector surface that is generally parabolically curved in a direction of the luminous element is at least one flat reflector surface;

whereby said downwardly and upwardly oriented reflectors delimit respective top and bottom chambers and direct light and in a generally funnel shape relative to an axis of the luminous element;

said bottom screen further comprising bottom-screen fluting receiving a direct light from said luminous element and a reflected light and whereby a portion of the downwardly emitted light is increased in relation to a laterally emitted light; and said top screen further comprising a top-screen fluting and receiving said direct light from said luminous element and said reflected light and diffusely scattering said direct light and said reflected light.

2. The luminaire, according to claim 1, wherein:

a first reflector which is located close to the rear wall, which further comprises:

the flat reflector surface of the bottom chamber and the parabolically curved reflector surface of the top chamber; and a second reflector, which further comprises:

the flat reflector surfaces of the bottom and top chambers.

3. The luminaire, according to claim 1, wherein:
the reflector surface of the top chamber that is located opposite of the parabolically curved reflector surface, further comprises:
two partial surfaces disposed at an angle relative to one another, wherein an outer partial surface is inclined more strongly relative to a designated vertical than an inner partial surface.

4. The luminaire, according to claim 1, wherein:
the housing of the luminaire, further comprises:
the rear wall designed as a profiled part;
a rail that is designed as a profiled part and is parallel to the rear wall;
a first lateral part and a second lateral part which are disposed perpendicular to the rear wall and the rail, and correspond to the cross-sectional shape of the housing, and;
the screens being removably insertable between the rear wall and the rail.

5. The luminaire, according to claim 4, wherein:
at least one of the screens, is pivotably mounted and can be pivoted away for service purposes.

6. The luminaire, according to claim 5, wherein:
a flute extends in the longitudinal direction is provided at an upper edge of the rear wall; and
the top screen being pivotably suspended in the flute with a rear lip.

7. The luminaire, according to claim 6, wherein:
a front lip is provided which runs on the top screen parallel to the rear lip and envelopes a front wall part delimiting the flute in a locking manner when the screen is closed.

8. The luminaire, according to claim 6, wherein:
the rear wall part delimiting the flute is extended toward a top and constitutes a stop for an open screen.

9. The luminaire, according to claim 5, wherein:
a downwardly projecting, spring-loaded lip is provided at a front edge of the top screen; and
the lip engaging in a corresponding groove of the rail in a latching manner.

10. The luminaire, according to claim 9, wherein:
an upper face of the top screen is flush with an upper face of the rail in a latched state.

11. A luminaire, according to claim 4, wherein:
at least one groove extending in the longitudinal direction is provided on a lower edge of the rear wall and on a lower edge of the rail, with the bottom screen being insertable respectively in the grooves with edges which correspond to a cross-section of each respective said groove.

12. The luminaire, according to claim 11, wherein:
a distance between the lower edge of the rear wall and the lower edge of the rail is smaller than a width of the bottom screen and a distance between a base of said groove provided on said lower edge of said rear wall and a base of said groove provided on said lower edge of said rail being from one another is greater than the width of the bottom screen; and
when the bottom screen is inserted in the grooves, at least one fixing pin provided on the lateral parts is inserted in a resulting free space between one said groove base and one of the edges of the bottom screen for fixing the position of the bottom screen.

13. The luminaire, according to claim 4, wherein:
the lateral parts are connected to the rear wall and the rail by at least one countersunk head screws, wherein respective countersunk holes in the lateral parts comprise lobular recesses that are engagable with respective heads of the countersunk head screws.

14. The luminaire, according to claim 4, wherein:
the rear wall comprises a series of keyhole-shaped cut-outs disposed at a distance from one another, which receive threaded pins which are provided on a supply duct or a wall and onto which nuts, can be screwed for fastening the luminaire.

15. The luminaire, according to claim 14, wherein:
a receiving flute is provided at the back on a lower edge of the rear wall, with a lug used for positional fixation engaging in this flute when installing the luminaire on a supply duct or a wall.

16. The, luminaire, according to claim 4, wherein:
an axially displaceable and latchable, spring-loaded locking pin is provided on one of the lateral parts, with a corresponding detent opening that is provided in another lateral parts being associated with this locking pin.

17. The luminaire, according to claim 4, wherein:
a cable for the electrical connection of the luminaire is disposed between the rear wall and the reflectors and is provided with a connector close to the lateral part, and the lateral part comprises a feedthrough opening that is associated with the connector.

* * * * *